United States Patent [19]

Growney

[11] Patent Number: 4,729,477

[45] Date of Patent: Mar. 8, 1988

[54] FOOD SCOOP WITH SEALED PRIZE CHAMBER

[75] Inventor: Lawrence J. Growney, Pearl River, N.Y.

[73] Assignee: Federal Paper Board Co., Inc., Montvale, N.J.

[21] Appl. No.: 428,783

[22] Filed: Sep. 30, 1982

[51] Int. Cl.[4] ..... B65D 5/41; B65D 81/36

[52] U.S. Cl. ..... 206/542; 141/109; 206/216; 206/611; 206/831; 229/120.17; 229/183; 294/55

[58] Field of Search ..... 141/108, 109; 206/216, 206/217, 218, 605, 606, 607, 608, 609, 611, 612, 542, 831; 229/8, 1.58, 15, 27, 30, 41 R, 418, 39 R, 183; 294/55, 172

[56] References Cited

U.S. PATENT DOCUMENTS

| | | | |
|---|---|---|---|
| 938,799 | 11/1909 | Teasdale | 229/27 |
| 2,325,756 | 8/1943 | Eggebrecht et al. | 229/27 |
| 2,331,754 | 10/1943 | Wohlers | 229/39 R |
| 3,182,792 | 5/1965 | Viltrakis | 229/27 |
| 3,298,596 | 1/1967 | Tolaas et al. | 206/608 |
| 3,305,159 | 2/1967 | Becker et al. | 206/612 |
| 3,370,776 | 2/1968 | Krzyzanowski | 229/27 |
| 3,752,307 | 8/1973 | German . | |
| 3,845,897 | 11/1974 | Buttery et al. | 229/8 |
| 3,954,220 | 5/1976 | Foster | 229/15 |
| 4,293,091 | 10/1981 | Gerard | 229/15 |

FOREIGN PATENT DOCUMENTS

| | | | |
|---|---|---|---|
| 1036133 | 7/1966 | United Kingdom . | |
| 2028770 | 3/1980 | United Kingdom | 229/8 |
| 2046218 | 11/1980 | United Kingdom . | |

*Primary Examiner*—Jimmy G. Foster
*Attorney, Agent, or Firm*—Charles E. Brown

[57] ABSTRACT

This relates to a food scoop having a false bottom defining in the bottom portion of the scoop a hidden chamber in which a prize or the like may be hidden. The construction of the scoop is such that it may be supplied in a completed folded state and may be easily erected at the site. Further, the hidden compartment is accessible as the scoop is being erected so that the selected prizes, etc. may be inserted into the compartment before the compartment moves into the bottom of the scoop. One of the sides of the scoop is provided with an easy opening feature so that access may be had to the hidden compartment by the purchaser of the product.

8 Claims, 6 Drawing Figures

FOOD SCOOP WITH SEALED PRIZE CHAMBER

This invention relates in general to new and useful improvements in food scoops, such as scoops for distributing french fries and like food products, and more particularly to a food scoop having a false bottom defining within the scoop a place for concealing a hidden prize or the like.

Most particularly, this invention relates to a food scoop which is provided with a false bottom overlying the normal bottom and wherein there is defined between the false bottom and the regular bottom a compartment which opens to one side of the scoop, and wherein that one side is provided with an opening forming device so that access to the compartment may be obtained.

Another feature of the invention is to provide in a food scoop a hidden compartment, the hidden compartment being defined by additional panels connected to the bottom of the scoop and wherein a terminal one of the additional panels is permanently secured to a side of the scoop to which the bottom is hingedly connected and wherein the additional panels are normally flat folded so that the entire scoop may be flat folded for shipment and storage.

Another feature of the scoop is the arrangement of the aforementioned additional panels wherein, after the scoop is generally erected to its tubular form, these flatly folded panels may be moved apart so as to define a sleeve into which a prize may be placed, and whereupon further folding of the panels, the sleeve becomes fully telescoped within the scoop and wherein a connecting panel between the scoop bottom and the false panel may be interlocked with one of the sides so as to retain a prize within the sleeve and render the scoop and prize relatively tamper proof or at least with tamper indicating means.

With the above, and other objects in view that will hereinafter appear, the nature of the invention will be more clearly understood by reference to the following detailed description, the appended claims and the several views illustrated in the accompanying drawings.

Figure 1:
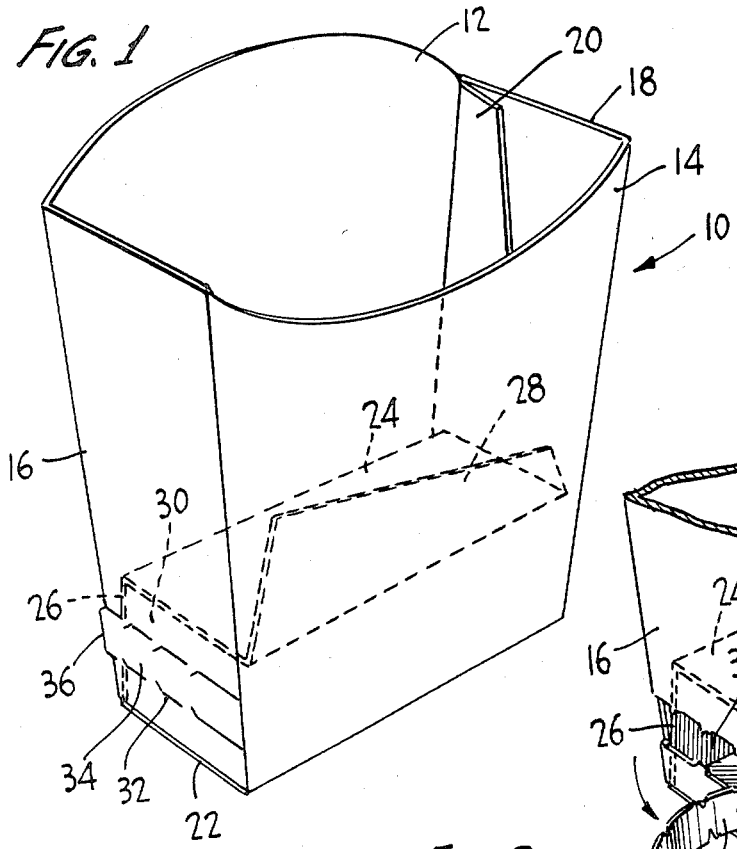
FIG. 1 is a perspective view showing a food scoop formed in accordance with this invention and being provided with a false bottom defining a prize receiving compartment.

Referring now to the drawings in detail, reference is made to FIG. 1 wherein there is illustrated a food scoop which is the subject of this invention, the food scoop being generally identified by the numeral 10 and being of the shape commonly associated with the dispensing of french fries in fast food restaurants. The scoop 10 includes a rear side 12, a front side 14 and two end sides 16 and 18. A connecting flap 20 is adhesively secured to the inner surface of the side 18 to complete the tubular form of the scoop 10.

The scoop 10 further includes a bottom 22 and a false scoop 24 with the false bottom being disposed within the scoop 10 and connected to the bottom 22 by an upstanding connecting panel 26. Finally, the scoop 10 includes a connecting panel 28 which extends upwardly from the false bottom 24 and is secured to the inner surface of the front side 14.

It will be seen that the bottom 22, in conjunction with the connecting panel 26, the fasle bottom 24 and a lower part of the front side 14 define a hidden chamber 30 which has open opposite ends with one of the open ends generally opposing the lower interior part of the end panel 16.

Figure 6:
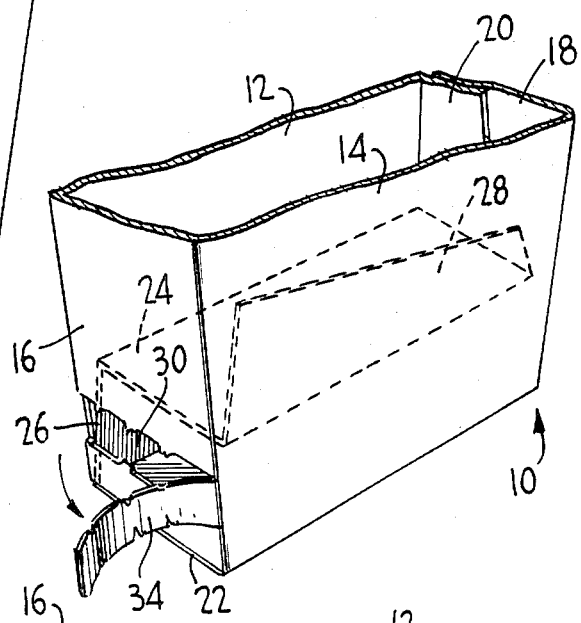
FIG. 6 is a fragmentary perspective view of the bottom portion of the scoop of FIG. 1 and shows the manner in which access may be obtained to the hidden compartment.

In order that access into the interior of the chamber 30 may be obtained, the lower part of the end side 16 is provided with a series of cuts 32 which define a transfer tear strip 34 having a free starting end 36. When the starting end 36 is grasped, as shown in FIG. 6, the tear strip 34 tears entirely across the side 16 and provides access into the compartment 30. A suitable prize or coupon placed within the compartment 30 now may be retrieved by the purchaser of the food product.

Figure 2:
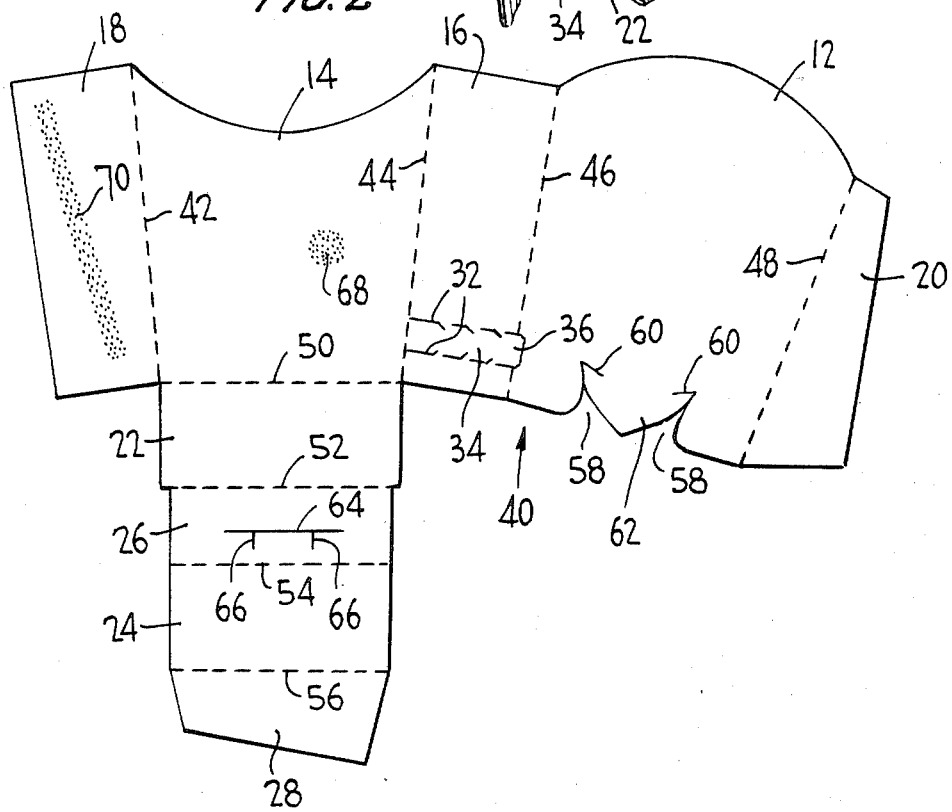
FIG. 2 is a plan view of a blank from which the food scoop of FIG. 1 is formed.

Reference is now made to FIG. 2 wherein there is illustrated the blank from which the scoop 10 is formed, the blank being generally identified by the numeral 40. The blank 40 is fomed of a suitable paperboard and includes the various scoop panels described above. It will be seen that the side 18 is connected to the front panel 14 along a fold line 42 while the side 16 is connected to the front side 14 along a fold line 44. In a like manner, the rear side 12 is connected to the side 16 along a fold line 46. Finally, the connecting flap 20 is connected to the rear side 12 along a fold line 48.

The bottom 22 is connected to the lower edge of the front side 14 along a fold line 50 while the connecting panel 26, which is of a reduced width as compared to the bottom 22, is connected to the bottom 22 along a fold line 52. The false bottom 24 is connected to the connecting panel 26 along a fold line 54 while the securing panel or flap 28 is connected to the false bottom 24 along a fold line 56.

The extreme lower central portion of the rear side 12 is provided with cut-outs 58 and cuts 60 so as to define a locking ear or tab 62. The connecting panel 26 is provided with an elongated cut line 64 and a pair of shorter cut lines 66 extending normal thereto for receiving the locking ear 62.

It will be seen that the inner surface of the front side or panel 14 is provided with an adhesive dot 68 while the inner surface of the side 18 is provided with an adhesive strip 70.

In accordance with the invention, the scoop 10 may be assembled into a flat ready to be erected state. This is accomplished by pivoting the connecting panel 26 along the fold line 52 so that the connecting panel 26, the false bottom 24 and the securing panel 28 generally overlie the bottom 22 and the front side 14. Thereafter, the rear side 12 and the securing flap or panel 20 may be folded along the fold line 46 into overlying relation to the folded panels 24, 26 and 28, which panels are additional panels. Finally, the side 18 may be folded into overlying relation to the connecting flap or panel 20 secured thereto by the adhesive 70.

Figure 3:
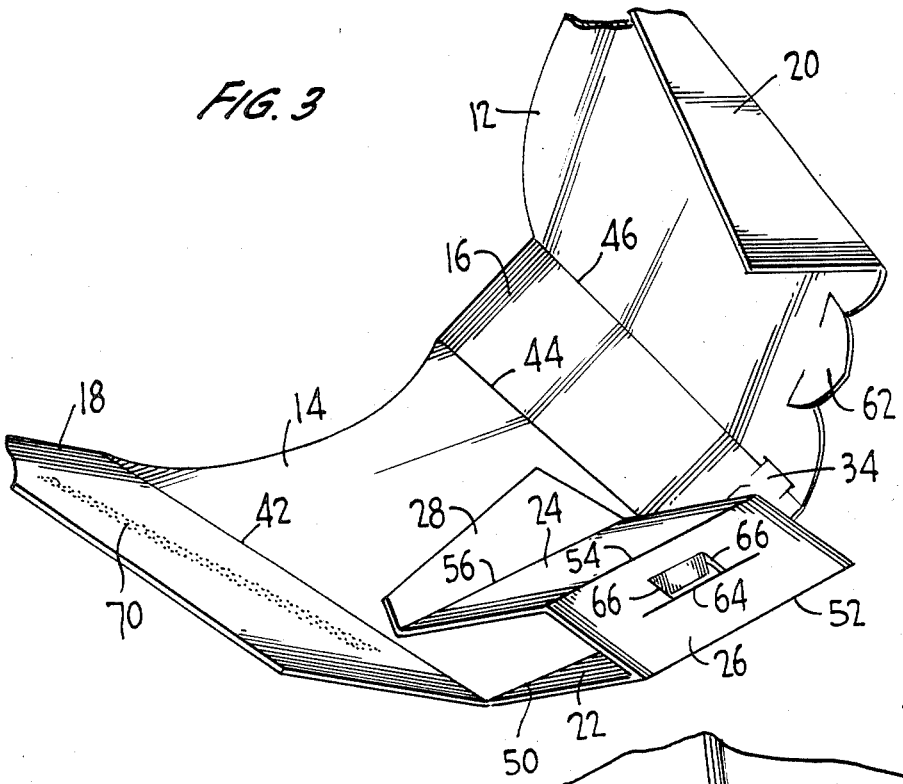
FIG. 3 is a perspective view showing generally the manner in which the blank is assembled to a flatly folded state.

The general folding or the blank 40 to form the flatly folded scoop 10 is illustrated in FIG. 3. The thus formed flat folded scoop 10 is ready for erection, and may be shipped to the ultimate user in that flatly folded state.

Figure 4:
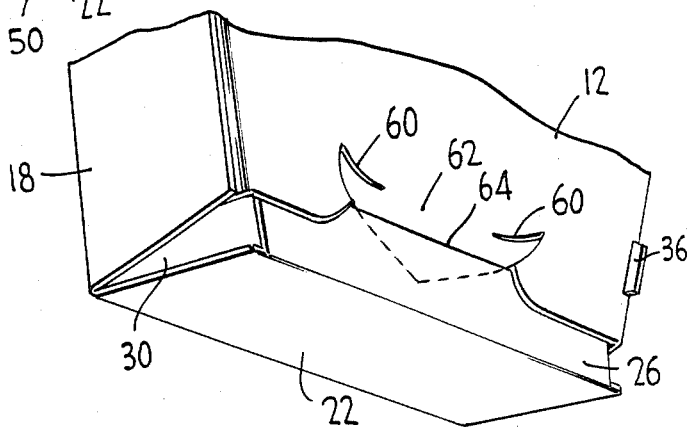
FIG. 4 is a fragmentary perspective view of the bottom portion of the scoop and shows the same being finally assembled.

At the site of the food distributor, the flatly folded scoop is generally squeezed at the fold lines 42 and 46 so as to erect the sides into a tubular configuration while the auxiliary panels 24, 26 and 28 remain in their flatly folded state. Then by pressing upwardly along the fold line 52, the bottom 22 may be swung towards its scoop closing position while the connection panel 26 moves upwardly towards the lower edge of the rear panel 12 and the tab 62 enters the locking slot 64. At this time, if the flatly folded carton has not been provided with a flat coupon or the like, a suitable prize or coupon may be inserted into the open end of the chamber 30 which remains exposed at this time, as is best shown in FIG. 4.

Figure 5:
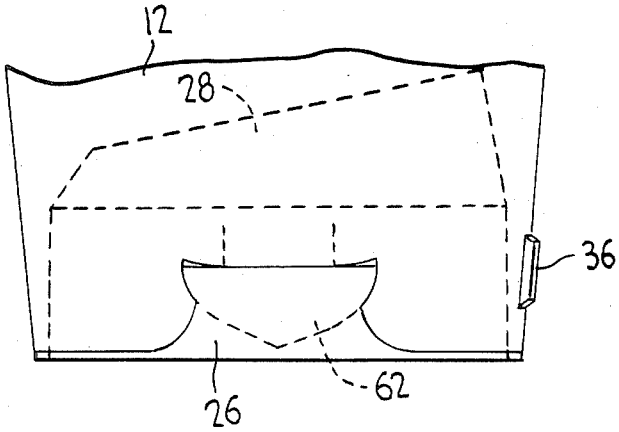
FIG. 5 is a fragmentary elevational view of the scoop of FIG. 1 showing the side thereof opposite from that shown in FIG. 1.

Thereafter, further upward movement of the bottom 22 with a like upward movement of the connecting panel 26 results in the completion of the interlock between the connecting panel 26 and the lower part of the rear side 12, as is shown in FIG. 5. The erection of the scoop 10 is now complete and the scoop is ready for use.

It will be seen that the construction of the scoop permits management to insert the desired prizes within the hidden compartment and to prevent the sales force from knowing in advance the nature of the prize or coupon hidden within the false bottom part of the scoop. In this way, prizes of different values may be distributed in a confidential manner.

Although only a preferred embodiment of the scoop has been specifically illustrated and described herein, it is to be understood that minor variations may be made in the scoop without departing from the spirit and scope of the invention as defined by the appended claims.

I claim:

1. A scoop for fried potatoes and the like, said scoop comprising an open ended tubular member including first and second sides and a bottom, said scoop being improved by a false bottom within said tubular member above said bottom and defining an auxiliary bottom chamber within said tubular member, said auxiliary bottom chamber opening towards one of said first sides, and said one first side having opening means providing access to said auxiliary bottom chamber, said false bottom being carried by a connecting panel in turn carried by said bottom, and a securing panel carried by said false bottom and secured to one of said second sides, said connecting panel being positioned adjacent the other of said second sides and interlocked therewith.

2. A scoop according to claim 1 wherein said connecting panel is interlocked with the other of said second sides by a tab and slot interlock.

3. A scoop for fried potatoes and the like, said scoop comprising an open ended tubular member including first and second sides and a bottom, said scoop being improved by a false bottom within said tubular member above said bottom and defining an auxiliary bottom chamber within said tubular member, said auxiliary bottom chamber opening towards one of said first sides, and said one first side having opening means providing access to said auxiliary bottom chamber, said false bottom being carried by a connecting panel in turn carried by said bottom, and a securing panel carried by said false bottom and secured to one of said second sides, said scoop in a partially erected state may have said one second side and said bottom lying in one common plane while said connecting panel, said false bottom and said securing panel lie in a second immediately adjacent common plane.

4. A scoop according to claim 3 wherein in a fully flattened state one of said first sides lies in said one common plane, and the other of both said first side and said second side lie in a third common plane with said second common plane lying between said one common plane and said third common plane.

5. A blank for forming a scoop in the form of an open ended tubular member having first and second sides, a bottom and false bottom within said tubular member above said bottom, said blank comprising a flat sheet divided by fold lines to define said first and second sides in adjacent alternating relation, said bottom being directly connected to a lower edge of one of said first sides with said false bottom being connected to said bottom by a connecting panel, and weakening lines in one of said second sides adjacent a lower edge thereof defining an opener strip.

6. A blank according to claim 5 wherein said blank also includes a securing panel hingedly connected to said false bottom.

7. A blank according to claim 5 wherein said connecting panel, said false bottom and said securing panel are reversely folded into overlying relation to said bottom and said one first side, and said securing panel is secured to said one first side in face to face relation, and said opener strip lies between a line forming an extension of said securing panel and said lower edge of said one second side.

8. A blank according to claim 5 wherein said weakening lines extend across one of said fold lines into an adjacent one of said first sides to define a starting end for said opener strip.

* * * * *